US010119398B2

(12) United States Patent
Rohs et al.

(10) Patent No.: US 10,119,398 B2
(45) Date of Patent: Nov. 6, 2018

(54) AXIAL-PISTON ENGINE, METHOD FOR OPERATING AN AXIAL-PISTON ENGINE, AND METHOD FOR PRODUCING A HEAT EXCHANGER OF AN AXIAL-PISTON ENGINE

(75) Inventors: Ulrich Rohs, Dueren (DE); Dieter Voigt, Aachen (DE)

(73) Assignee: GETAS Gesellschaft fuer termodynamische Antriebssysteme mbH, Dueren (DE)

( * ) Notice: Subject to any disclaimer, the term of this patent is extended or adjusted under 35 U.S.C. 154(b) by 204 days.

(21) Appl. No.: 13/386,596

(22) PCT Filed: Jul. 26, 2010

(86) PCT No.: PCT/DE2010/000874

§ 371 (c)(1),
(2), (4) Date: Jan. 23, 2012

(87) PCT Pub. No.: WO2011/009451

PCT Pub. Date: Jan. 27, 2011

(65) Prior Publication Data

US 2012/0118261 A1 May 17, 2012

(30) Foreign Application Priority Data

Jul. 24, 2009 (DE) ..... 10 2009 034 738

(51) Int. Cl.
*F02B 53/00* (2006.01)
*F01B 3/00* (2006.01)
(Continued)

(52) U.S. Cl.
CPC ..... *F01B 3/00* (2013.01); *F01B 3/0005* (2013.01); *F02G 3/02* (2013.01); *F23D 11/446* (2013.01);
(Continued)

(58) Field of Classification Search
CPC ..... F02B 53/00; F01B 3/00; F01B 3/0005; F01B 3/0017; F01B 3/0029; F01B 3/0082;
(Continued)

(56) References Cited

U.S. PATENT DOCUMENTS 972,504 A 10/1910 Brown
2,493,073 A 1/1950 Kinneen
(Continued)

FOREIGN PATENT DOCUMENTS

DE 627 655 3/1936
EP 0 085 409 8/1983
(Continued)

OTHER PUBLICATIONS

International Search Report of PCT/DE2010/000874, dated Feb. 9, 2011.

*Primary Examiner* — Lindsay Low
*Assistant Examiner* — Omar Morales
(74) *Attorney, Agent, or Firm* — Collard & Roe, P.C.

(57) ABSTRACT

The aim of the invention is to improve the efficiency of an axial-piston motor comprising at least one working cylinder fed by a continuously operating combustion chamber comprising a pre-combustion chamber and a main combustion chamber. To this end, the axial-piston motor is provided with a pre-combustion chamber comprising a check valve.

14 Claims, 4 Drawing Sheets

Figure 1:
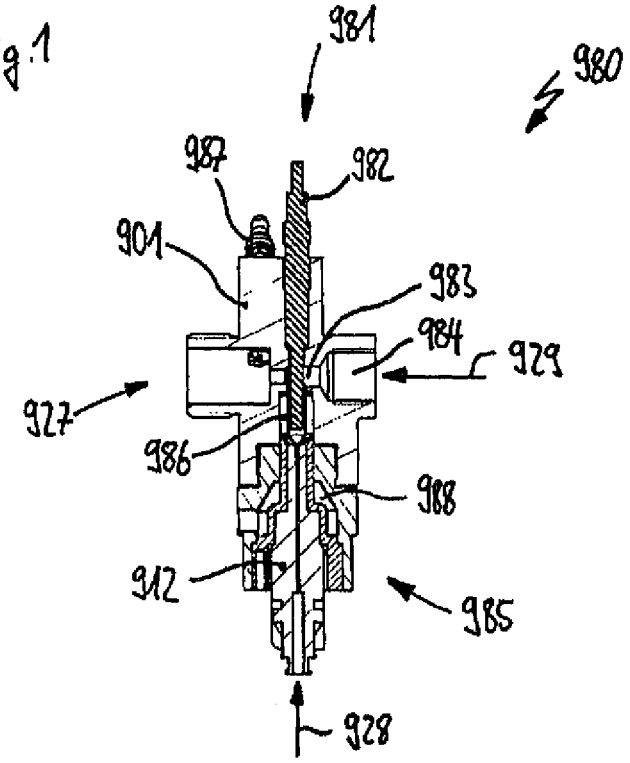

(51) Int. Cl.

| | |
|---|---|
| ***F02G 3/02*** | (2006.01) |
| ***F23D 11/44*** | (2006.01) |
| ***F23K 5/08*** | (2006.01) |
| ***F23K 5/16*** | (2006.01) |
| ***F23K 5/20*** | (2006.01) |

(52) U.S. Cl.
CPC ..... *F23K 5/08* (2013.01); *F23K 5/16* (2013.01); *F23K 5/20* (2013.01); *F23K 2900/05081* (2013.01)

(58) Field of Classification Search
CPC .... F01B 3/0091; F23D 11/446; F23D 11/448; F23K 5/20
USPC ..... 123/216, 70 R, 560; 417/364
See application file for complete search history.

(56) References Cited

U.S. PATENT DOCUMENTS 4,362,477 A * 12/1982 Patten ..... F04B 17/05 188/67
4,459,084 A * 7/1984 Clark ..... 417/11
4,565,167 A * 1/1986 Bryant ..... F02B 33/22 123/560
4,599,861 A * 7/1986 Beaumont ..... F02B 71/045 123/46 SC
4,635,590 A 1/1987 Gerace
6,334,300 B1 1/2002 Mehail
6,412,273 B1 * 7/2002 Rohs ..... F01B 3/0005 60/39.6
6,854,437 B1 12/2005 Vazquez
7,451,727 B2 * 11/2008 Sergeev ..... F02B 17/00 123/274
2004/0146825 A1 * 7/2004 Kramer ..... B60H 1/2203 431/208
2007/0017201 A1 * 1/2007 Zajac ..... F01B 31/14 60/39.6
2009/0179424 A1 * 7/2009 Yaron ..... B60K 6/24 290/52
2010/0051003 A1 * 3/2010 Negre ..... B60K 6/12 123/70 R
2010/0258065 A1 * 10/2010 Rohs ..... F01B 3/0005 123/56.1

FOREIGN PATENT DOCUMENTS

EP 1 035 310 9/2000
GB 535090 A * 3/1941 ..... F16J 1/01
WO WO 2009/062473 5/2009

* cited by examiner

AXIAL-PISTON ENGINE, METHOD FOR OPERATING AN AXIAL-PISTON ENGINE, AND METHOD FOR PRODUCING A HEAT EXCHANGER OF AN AXIAL-PISTON ENGINE

CROSS REFERENCE TO RELATED APPLICATIONS

This application is the National Stage of PCT/DE2010/000874 filed on Jul. 26, 2010, which claims priority under 35 U.S.C. § 119 of German Application No. 10 2009 034 738.0 filed on Jul. 24, 2009. The international application under PCT article 21(2) was not published in English.

The invention relates to an axial-piston engine. The invention also relates to a method for operation of an axial-piston engine and to a method for production of a heat exchanger of an axial-piston engine.

Axial-piston engines are sufficiently known from the state of the art, and are characterized as energy-converting machines, which provide mechanical rotational energy on the output side with the aid of at least one piston, wherein the piston executes a linear oscillatory motion whose alignment is aligned essentially coaxially with the axis of rotation of the rotational energy.

In addition to axial piston engines that are operated, for example, only with compressed air, axial-piston engines to which a combustion agent is supplied are also known. This combustion agent can be made up of a plurality of components, for example a fuel and air, wherein the components are fed, together or separately, to one or more combustion chambers.

In the present case, the term "combustion agent" thus designates any material that participates in the combustion, or with which components that participate in the combustion are carried, and which flows through the axial-piston engine. The combustion agent then includes at least a combustible substance or fuel, wherein the term "fuel" in the present context therefore describes any material that reacts exothermally by way of a chemical reaction or other reaction, in particular by way of a redox reaction. In addition, the combustion agent can also have components such as air, for example, which provide materials for the reaction of the fuel. The combustion agent can also include components that are effective catalytically or at a different location, such as special chemical additives or else even water.

In particular, axial-piston engines can also be operated under the principle of internal continuous combustion (icc), according to which combustion agent, i.e., for example fuel and air, is fed continuously to a combustion chamber or to a plurality of combustion chambers.

Moreover, axial-piston engines can work on the one hand with rotating pistons, and correspondingly rotating cylinders, which are moved successively past a combustion chamber.

On the other hand, axial-piston engines can have stationary cylinders, wherein the working medium is then successively distributed to the cylinders according to the desired loading sequence.

The axial-piston engines disclosed in EP 1 035 310 A2 and in WO 2009/062473 A2 have a separation between working cylinders and the corresponding working pistons, and compressor cylinders and the corresponding compressor pistons, wherein the compressor cylinders are provided on the side of the axial-piston engine facing away from the working cylinders. In this respect, a compressor side and a working side can be assigned to such axial-piston engines.

It is understood that the terms "working cylinder," "working piston" and "working side" are used synonymously with the terms "expansion cylinder," "expansion piston" and "expansion side" or "expander cylinder," "expander piston" and "expander side," as well as synonymously with the terms "expansion stage" or "expander stage," wherein an "expander stage" or "expansion stage" designates the totality of all "expansion cylinders" or "expander cylinders" located therein.

The task of the present invention is to improve the efficiency of an axial-piston engine.

This task is accomplished by an axial-piston engine with at least one working cylinder, which is fed from a continuously working combustion chamber that comprises a precombustion chamber and a main combustion chamber, which is characterized by a precombustion chamber with a check valve.

Because the precombustion chamber of the axial-piston engine has at least one working cylinder, which is fed from a continuously working combustion chamber that comprises a precombustion chamber and a main combustion chamber, and has a check valve, combustion can be made especially well uniform, in particular during starting processes, whereby the efficiency of the present axial-piston engine can be further improved.

As a check valve, any device can be used that is well resistant to heat. For example, such a check valve has a ceramic valve ball that runs against a valve seat as soon as the check valve is to seal. However, any other valve arrangement can also be used by means of which hot gases for example can be prevented from breaking into a combustion fuel supply in critical measure, for example into a combustion air supply line.

Thus, with the check valve, critical blowbacks into a combustion agent supply line can be prevented using a simple construction. Such check valves are not known from the state of the art in connection with a precombustion chamber in axial-piston engines, in particular with regard to internal continuous combustion.

An especially advantageous alternative embodiment provides that the check valve is situated in a combustion agent supply line. In this way, the check valve can be situated already ahead of an access to a combustion space of the precombustion chamber.

It is especially advantageous if the check valve is situated in a fuel supply line. In this case, critical blowbacks into the fuel supply line, and thus also accompanying disturbances within the combustion chamber of the precombustion chamber, can be advantageously prevented. This can contribute to a significant improvement of the efficiency.

Cumulatively or alternatively, the check valve can also be situated in a combustion air supply line. In this way, blowbacks of ignited combustion agent into the combustion air supply and an accompanying disturbance of an associated combustion air supply flow can be well prevented.

In addition, the check valve can advantageously also be situated in a mixing pipe for mixing fuel and other combustion agents. In this way, the check valve can be correspondingly effective for both components that are to be mixed.

The task of the invention is likewise accomplished by an axial-piston engine with at least one working cylinder that is fed from a continuously working combustion chamber, which includes a precombustion chamber and a main combustion chamber, in which the precombustion chamber includes a fuel processing system.

Advantageously, the technical process of the combustion of combustion agent can be influenced easily by means of such a fuel processing system, whereby an efficiency increase with regard to the efficiency of the present axial-piston engine can likewise be achieved. In particular, it is possible to attain the assurance of a blue flame in the precombustion chamber under the greatest possible number of operating situations of the axial-piston engine, so that optimal combustion of the combustion agent can always be achieved. In this connection, a fuel processing system is understood to mean any measure that acts on the fuel or combustible substance that promotes its combustion, before it reaches a precombustion chamber. In particular, this relates to a fuel processing system when the fuel has not already come into contact with combustion air. On the other hand, the fuel processing system for the precombustion chamber according to the invention can also include a processing of combustion agent in general, i.e., of fuel or of combustible substance and of combustion air, as well as other components.

An especially preferred design variant of the axial-piston engine on which the invention is based provides that the fuel processing system includes a fuel heater, for example a glow plug, a glow coil, an induction heater or a laser heater. An advantageous heating of the fuel can be realized if the fuel is already preheated ahead of an injection nozzle by exhaust gases from the axial-piston engine. Granted, it is known to preheat combustion air by means of exhaust gases, but it is not known in this connection to preheat a fuel, cumulatively or alternatively.

Fuels can be advantageously preheated by such a fuel heater, so that an ignition behavior and/or a combustion of the fuels can be further optimized. In particular, a processed, primarily preheated fuel can vaporize more easily in the precombustion chamber. Also, the combustion air can mix significantly better with the fuel, whereby the combustion can proceed more effectively.

A fuel processing can occur advantageously in particular with the fuel heaters named above as examples, if the fuel heater has a power of approximately 200 W during starting of the axial-piston engine. In this way, vaporizing of the fuel can be promoted. In continuous operation the power can be reduced to approximately 80 W.

Through additional warming of the fuel by exhaust gases, the last-named power can possibly be reduced again. In any case, the fuel can also be heated by an exhaust gas. With appropriate configuration, this exhaust gas temperature can already be sufficient to preheat the fuel to the ignition temperature, so that on contact with the other combustion agent, in particular with the combustion air, it can ignite autonomously and immediately.

Vaporization requires about 250° C. for gasoline to 1,350° C. for diesel. By inputting combustion air through various air supply holes, the temperature can easily be controlled supplementally if necessary. In the case of fuel heating by means of a glow coil in particular a temperature-dependent resistance can be used, which acts in a self-regulating manner by means of its temperature dependence.

It is also advantageous if the fuel processing system is situated ahead of a mixing pipe for mixing fuel and other combustible substances. This results ideally in an advantageous heating of the fuel already before mixing of the fuel with other combustible substances, which can result in a significantly more intimate mixing. In this respect, an improvement in the efficiency can likewise be achieved thereby.

Unusually good combustion of the combustible substances can be ensured if the fuel processing system vaporizes the fuel before it enters the precombustion chamber or before it enters the mixing pipe. In particular, the development of soot particles can ideally be totally prevented thereby, whereby if appropriate a downstream processing of exhaust gases can be simplified.

In addition, the task of the present invention is also accomplished by an axial-piston engine with at least one working cylinder, which is fed from a continuously working combustion chamber that includes a precombustion chamber and a main combustion chamber, and in which the main combustion chamber has an eccentric combustion agent input.

Through such an eccentrically situated combustion agent input into the precombustion chamber, an unusually good flame stability can be achieved, in particular in combination with the check valve depicted above. Presumably this is accomplished by an extremely good swirling action of the combustion materials within the precombustion chamber. Advantageously, this results in a further improved efficiency, as well a further reduced emission of pollutants.

Such an eccentric input of combustion agent is also characterized in the present case by the fact that the center axis of an associated component, such as an injection nozzle, or of an associated group of components, is situated eccentrically to the center axis of the precombustion chamber. In this way, the present input of combustion agent differs from an input of combustion agent from a perforated ring from international patent application WO 2009/062473 A2, whose center axis is flush with the center axis of the associated combustion chamber.

Cumulatively or alternatively, the task of the invention is also accomplished by an axial-piston engine with at least one working cylinder, which is fed from a continuously working combustion chamber that includes a precombustion chamber and a main combustion chamber, and in which the axial-piston engine is characterized by a preburner with a spark plug.

If the preburner has a spark plug, the starting of the axial-piston engine in particular can be significantly improved and simplified, whereby as a result the efficiency of the axial-piston engine is likewise increased, especially if the axial-piston engine is embedded in a hybrid concept and especially is to be switched on and off frequently in city traffic.

Influence can be exerted especially well in particular on the starting behavior of the axial-piston engine if the spark plug is situated in a combustion space of the precombustion chamber, i.e., in the precombustion chamber.

But even if the spark plug is situated in a mixing pipe for mixing fuel and other combustible substances of the precombustion chamber, the operation of the axial-piston engine can be influenced very favorably.

In particular, harder knocks of the axial-piston engine during ignition can be prevented by the provision of such a spark plug described above.

Ideally, in this case the spark plug is provided close to the input of the combustion agent. Furthermore, it has been found that it is advantageous if the spark plug is situated in the area of the maximum combustion chamber diameter. Both factors can have an especially advantageous effect on the smoothness of operation of the axial-piston engine.

The task of the invention is also accomplished by an axial-piston engine with at least one working cylinder that is fed from a continuously working combustion chamber, which includes a precombustion chamber and a main combustion chamber, wherein the axial-piston engine is characterized in that the precombustion chamber has two combustion air inputs.

By means of a plurality of combustion air inlets, the combustion air ratio lambda (λ), i.e., the ratio of oxygen to fuel, can be adjusted particularly unproblematically. In the known manner, the entire fuel can be burned thoroughly at a value of λ=1, since exactly as much oxygen is available as is necessary for burning the entire fuel. Or else a leaner combustion mixture with a value of λ>1 is adjusted with an oxygen surplus. However, even a richer combustion mixture with Lambda<1 and an oxygen deficit can be adjusted particularly uniformly and rapidly when two combustion air inlets are provided.

Regulation of the two combustion air inlets can take place advantageously in dependence on speed of revolution. Alternatively, however, regulation can also be undertaken in dependence on power, so that in both cases substantially better regulation of the combustion air supply can be achieved. For example, the second or a further combustion air inlet will be opened when this is advantageous for an operating state of the axial-piston engine.

If, in addition, the two combustion air inlets are designed for combustion air at different temperatures, easy tempering of the flame in the combustion chamber can be enabled, whereby the combustion can be controlled more simply.

It must be pointed out here that these same combustion air inlets to the combustion chamber do not always have to be used. Instead, even combustion air inlets that lead, for example, into an upstream pipe for mixing of combustion agent can be advantageously used.

If the axial-piston engine has at least one heat exchanger, it is advantageous when a first combustion air inlet is fed by combustion air ahead of a heat exchanger and a second combustion air inlet is fed by combustion air behind this or another heat exchanger. Hereby it is possible, in structurally particularly simple manner, to supply combustion air at different temperatures. Especially in this case, regulation of the combustion air inputs can also take place on the basis of the efficiency.

It can also be ensured, in particular during the use of combustion air that is tapped behind a heat exchanger, that the combustion air is not too cold when it enters the preburner or the combustion chamber of an axial-piston engine. This has in particular the advantage that processed or pretempered or vaporized fuel is not chilled unnecessarily by the combustion air with which the fuel is brought into contact, so that the effect if the processing is diminished. It is understood in this case that instead of a tempering of the combustion air by heat exchangers, a tempering by a separate heater, for example in the form of a spark plug, a spark coil, an induction heater or a laser heater, can also be provided. The tempering by a separate heater has the advantage that the corresponding temperature is available immediately, and that such a heater can usually be designed with a lower flow resistance for the combustion air than is the case with a heat exchanger. Otherwise it is understood that a heat exchanger can be used if the latter can be equipped with a lower flow resistance. This ensures that the preburner works with sufficiently high pressure, so that an adequate volume flow through the preburner into the main burner is operationally reliably maintained. The latter is true in particular if combustion air processed via heat exchangers is fed to the main burner, which therefore defines the pressure in the main combustion chamber, since the combustion air that enters the main combustion chamber through the preburner is then at a higher pressure.

Alternatively or cumulatively to this, the task of the invention can accordingly be accomplished by an axial-piston engine with at least one compression cylinder, with at least one working cylinder and with at least one pressure line, through which compressed combustion agent is conducted from the compressor cylinder to the working cylinder, wherein the flow of combustion agent from the combustion chamber to the working cylinder is controlled by means of at least one control piston, and the axial-piston engine is characterized in that that the combustion chamber has a combustion chamber floor of reflective metal.

In addition, the reflectiveness of a metal surface brings the advantage that the flow of heat in the wall that arises due to the high temperature difference between the burned combustion agent and the metal surface can be reduced, at least for the flow of heat in the wall caused by heat radiation. A large proportion of efficiency losses in an internal combustion engine arises due to this named wall heat flow, for which reason a reduction of the wall heat flow gives an efficient possibility for increasing the thermodynamic efficiency of the axial-piston engine through the proposed accomplishments of the invention.

It is understood that on the one hand non-metallic surfaces can also yield an advantage in thermodynamic efficiency through reflectiveness, and that on the other hand this advantage in thermodynamic efficiency can be attained cumulatively or alternatively by the fact that also a different component of the axial-piston engine, possibly even every component that is in contact with combustion agent, is reflective or can be reflective, if the temperature of the combustion agent is higher than the wall temperature.

Furthermore, it is understood that any other surface coating which is capable of increasing the spectral reflectivity of the component surfaces can be used. Furthermore, of course any surface coating is conceivable which alternatively or cumulatively to this reduces the heat transmission coefficient of a component surface through reduced heat conduction, in order to reduce the proportion of thermodynamic losses through convection.

The task of the present invention is accomplished, cumulatively or alternatively to the other features of the present invention, by an axial-piston engine with a combustion agent supply system and an exhaust gas removal system that are coupled with one another with heat transfer, which axial-piston engine is characterized by at least one heat exchanger insulation system. In this way it is possible to ensure that as much thermal energy as possible remains in the axial-piston engine and is re-used by way of the transfer of heat to the combustion agent.

In this connection, it is understood that the heat exchanger insulation does not necessarily have to completely surround the heat exchangers, since some waste heat can possibly also be used advantageously at a different location in the axial-piston engine. However, the heat exchanger insulation should be provided in particular toward the outside.

Preferably, the heat exchanger insulation is designed so that it leaves a maximum temperature gradient between the heat exchanger and the environment of the axial-piston engine of 400° C., in particular of at least 380° C. In particular as the transfer of heat progresses, i.e., toward the compressor side, the temperature gradient can then quickly become significantly smaller. Cumulatively or alternatively to this, the heat exchanger insulation can preferably be designed so that the exterior temperature of the axial-piston engine in the area of the heat exchanger insulation does not exceed 500° C. or 480° C. In this way it is ensured that the quantity of energy lost through heat radiation and heat transfer is reduced to a minimum, since otherwise the losses rise disproportionately at even higher temperatures or temperature gradients. Furthermore, the maximum temperature or maximum temperature gradient occurs only at a small location, since the temperature of the heat exchanger decreases more and more toward the compressor side.

Preferably, the heat exchanger insulation comprises at least one component made of a material that differs from the heat exchanger. This material can then be designed optimally for its task as insulation, and can comprise for example asbestos, an asbestos substitute, water, exhaust gas or air, wherein the heat transfer insulation must have a housing in the case of fluid insulation materials, in particular in order to minimize heat transport through material movement, while in the case of solid insulation materials a housing can be provided for stabilization or as protection. In particular, the housing can be formed from the same material as the jacket material of the heat exchanger.

The task of the invention is also accomplished by an axial-piston engine with at least one working cylinder, which is fed from a continuously working combustion chamber which includes a precombustion chamber and a main combustion chamber and which has an exhaust gas outlet, wherein the axial-piston engine is characterized by a precombustion chamber temperature sensor for determination of the temperature in the precombustion chamber.

A temperature sensor of this sort delivers, in a simple manner, a meaningful value regarding the quality of the combustion or regarding the running stability of the axial-piston engine. Any sensor, for example a resistance temperature sensor, a thermocouple, an infrared sensor or the like, can be used as a temperature sensor.

Preferably, the precombustion chamber temperature sensor is designed or situated so that it determines the temperature of a flame in the precombustion chamber. This makes especially appropriately meaningful values possible.

The axial-piston engine can include in particular a combustion chamber regulating system, which includes the precombustion chamber temperature sensor as input sensor and regulates the combustion chamber so that the prechamber temperature is between 1,000° C. and 1,500° C. In this way it is possible, by means of a relatively simple and therefore operationally reliable and very fast regulating circuit, to guarantee that the axial-piston engine produces extremely low volumes of pollutants. In particular, the danger of soot developing can be reduced to a minimum. The prechamber temperature can be regulated especially quickly, and hence advantageously, if two or even more combustion air feeds are used, in particular with combustion air at different temperatures.

Furthermore, cumulatively or alternatively to the above, the axial piston engine can include an exhaust gas temperature sensor for determination of the exhaust gas temperature.

By means of such an exhaust gas temperature sensor, the operating state of a continuously working combustion chamber can likewise be checked and regulated in a technically simple way. Such a regulating system ensures adequate and complete combustion of fuel, in particular in a simple way, so that the axial-piston engine exhibits optimal efficiency with minimum emission of pollutants.

By preference, the combustion chamber is regulated so that the exhaust gas temperature in an operating state, preferably when idling, is between 850° C. and 1,200° C. The latter can be done for example through the appropriate application of water and/or appropriate preheating of the combustion agent, in particular of air, for example by controlling the water temperature or volume of water or the proportion of air preheated or not preheated in a heat exchanger, in accordance with the aforementioned requirement. One, such operating state is advantageously in particular an idling of the axial-piston engine, whereby a further reduction of pollutants can be achieved.

Regulation of this type on the basis of a water cooling system is likewise not known from the state of the art relevant at the beginning.

In this respect, the task of the invention is accomplished in addition by an axial-piston engine with at least one working cylinder that is fed from a continuously working combustion chamber, which includes a precombustion chamber and a main combustion chamber, wherein the axial-piston engine is characterized by a combustion chamber regulating system that includes an application of water into the combustion chamber.

An expanded regulating option can be achieved if the application of water is provided independently of an application of water in or ahead of a combustion agent compressor, wherein water can be applied in particular for cooling directly to the combustion chamber, for example directly into a precombustion chamber, but also directly into a main combustion chamber.

If the application of water is used for regulation of an exhaust gas temperature, in particular the transfer of heat at a heat exchanger to the combustion air can accordingly be regulated advantageously. This enables an optimization of the efficiency, since the exhaust gas temperature can be regulated so that insofar as possible all thermal energy from the exhaust gas is recovered in the heat exchanger.

The proportion of water can be used supplementally—depending on the concrete implementation—for regulation of the temperature in the combustion chamber, and/or also for reduction of pollution by means of chemical or catalytic reactions of the water.

According to another aspect of the invention, an axial-piston engine with a compressor stage comprising at least one cylinder, with an expander stage comprising at least one cylinder, and with at least one heat exchanger is proposed, wherein the heat-absorbing part of the heat exchanger is situated between the compressor stage and the combustion chamber and the heat-emitting part of the heat exchanger is situated between the expander stage and an environment, and wherein the axial-piston engine is characterized in that the heat-absorbing and/or the heat-emitting part of the heat exchanger has, downstream and/or upstream, means for applying at least one fluid.

The application of a fluid into the stream of combustion agent can contribute to an increase in the transfer capacity of the heat exchanger, for example since the specific heat capacity of the stream of combustion agent can be adjusted to the specific heat capacity of the exhaust gas stream, through the application of a suitable fluid, or else can be increased beyond the specific heat capacity of the exhaust gas stream. The transfer of heat from the exhaust gas stream to the combustion agent stream influenced thereby, for example advantageously, contributes to enabling a higher volume of heat being able to be coupled into the combustion agent stream and thus into the working cycle while the construction size of the heat exchanger remains the same, whereby the thermodynamic efficiency can be increased. Alternatively or cumulatively, a fluid can also be applied to the exhaust gas stream. The applied fluid in this case can be for example a necessary aid for a downline exhaust gas post-treatment, which can be mixed ideally with the exhaust gas stream by a turbulent flow formed in the heat exchanger, so that a downline exhaust gas post-treatment system can thus be operated with maximum efficiency.

"Downstream" designates in this case the side of the heat exchanger from which the respective fluid emerges, or that part of the exhaust gas line or of the pipework carrying the combustion agent into which the fluid enters after leaving the heat exchanger.

By analogy to this, "upstream" designates the side of the heat exchanger into which the respective fluid enters, or that part of the exhaust gas line or of the pipework carrying the combustion agent from which the fluid enters into the heat exchanger.

In this respect, it is not important whether the application of the fluid is made directly in the immediate spatial environment of the heat exchangers, or whether the application of the fluid occurs at a greater spatial distance.

As fluid, water and/or combustible substance for example can be applied appropriately. This has the advantage that the combustion agent stream has on the one hand the previously described advantages of an increased specific heat capacity through the application of water and/or combustible substance, and on the other hand that the mixture can be prepared already in the heat exchanger or ahead of the combustion chamber and the combustion can take place in the combustion chamber with a combustion air ratio of the greatest possible local homogeneity. This also has in particular the advantage that the combustion behavior is marked only very slightly or not at all with efficiency-degrading, incomplete combustion.

For another configuration of the axial-piston engine, it is proposed that a water trap be situated in the heat-emitting part of the heat exchanger or downstream from the heat-emitting part of the heat exchanger. Because of the reduced temperature existing at the heat exchanger, vaporous water could condense out and damage the subsequent exhaust gas line by corrosion. Damage to the exhaust gas line can be reduced advantageously through this measure.

In addition, a method for operating an axial-piston engine with a compressor stage comprising at least one cylinder, with an expander stage comprising at least one cylinder, with at least one combustion chamber between the compressor stage and the expander stage and with at least one heat exchanger is proposed, wherein the heat-absorbing part of the heat exchanger is situated between the compressor stage and the combustion chamber and the heat-emitting part of the heat exchanger is situated between the expander stage and an environment, and wherein the method is characterized in that at least one fluid is applied to the combustion agent stream flowing through the heat exchanger and/or to the exhaust gas stream flowing through the heat exchanger. It is hereby possible—as already shown above—to improve the efficiency-enhancing transfer of heat from an exhaust gas stream being conducted into an environment into a combustion agent stream, by increasing the specific heat capacity of the combustion agent stream through the application of a fluid, and thus also increasing the flow of heat to the combustion agent stream. The regenerative coupling of an energy stream into the working cycle of the axial-piston engine in this case can in turn bring about an increase in the efficiency, in particular an increase in the thermodynamic efficiency, when the process is carried out appropriately.

Advantageously, the axial-piston engine is operated in such a way that water and/or combustible substance are applied, as already explained. The result of this procedure is that the degree of efficiency in turn, in particular the efficiency of the combustion process, can be increased through ideal mixing in the heat exchanger and ahead of the combustion chamber.

Combustible substance can likewise be applied to the exhaust gas flow, if this is expedient for example for an exhaust gas aftertreatment, so that the exhaust gas temperature can be further increased in the heat exchanger or after the heat exchanger. This can possibly also cause a postcombustion to occur, which aftertreats the exhaust gas in an advantageous manner and minimizes pollutants. Heat released in the heat-emitting part of the heat exchanger could thus also be used indirectly for further warming of the combustion agent stream, so that the efficiency of the axial-piston engine is hardly influenced negatively thereby.

In order to further implement this advantage, it is further proposed that the fluid be applied downstream and/or upstream from the heat exchanger.

Cumulatively or alternatively to this, separated water can be applied back into the combustion agent stream and/or the exhaust gas stream. In the most favorable case, a closed water circuit is thereby realized, to which no additional water needs to be supplied from outside. Thus an additional advantage arises from the fact that a vehicle equipped with an axial-piston engine of this construction does not have to be refilled with water, in particular not with distilled water.

Advantageously, the application of water and/or combustible substance is stopped at a defined point in time before the axial-piston engine comes to a standstill, and the axial-piston engine is operated until it comes to a stop without application of water and/or combustible substance. The water, possibly harmful for an exhaust gas line, which can be deposited in the exhaust gas line, in particular when the latter cools, can be avoided by this method. Advantageously, any water is also removed from the axial-piston engine itself before the axial-piston engine comes to a stop, so that damage to components of the axial-piston engine by water or water vapor, especially during the stoppage, is not promoted.

The task mentioned at the beginning is also accomplished by a method for production of a heat exchanger of an axial-piston engine which has a compressor stage comprising at least one cylinder, an expander stage comprising at least one cylinder and at least one combustion chamber between the compressor stage and the expander stage, wherein the heat-absorbing part of the heat exchanger is situated between the compressor stage and the combustion chamber and the heat-emitting part of the heat exchanger is situated between the expander stage and an environment, whereby the heat exchanger includes at least one pipe wall dividing the heat-emitting part from the heat-absorbing part of the heat exchanger for separation of two streams of material, and wherein the production process is characterized in that the pipe is situated in at least one matrix consisting of a material corresponding to the pipe, and connected materially or frictionally to this matrix.

The use of a heat exchanger in an axial-piston engine described above can lead to disadvantages through the occurrence of especially high temperature differences between the input and between the output of the heat exchanger on the one hand and between the heat-absorbing and heat-emitting part of the heat exchanger on the other hand, due to damage to the material that limits the service life. In order to counter resultant thermal stresses and losses of combustion agent or exhaust gas that occur due to damage, with appropriate configuration, according to the proposal described above, a heat exchanger can be produced advantageously almost exclusively of only one material at its points that are subject to a critical stress. Even if the latter is not the case, material stresses are advantageously reduced through the accomplishment described above.

It is understood that a solder or other means used for attaching or mounting the heat exchanger can consist of a different material, in particular if the areas involved do not have a high thermal load or a high demand for seal tightness.

The use of two or more materials with the same thermal expansion coefficient is also conceivable, wherein the occurrence of thermal stresses in the material can be countered in a similar way.

To construct a material and/or frictional connection between the pipe and the matrix, a method for production of a heat exchanger is also proposed which is characterized in that the material connection between the pipe and the matrix is made by welding or soldering. The seal tightness of a heat exchanger is ensured in a simple manner and especially advantageously by a method of this sort. In this case it is again also possible to use a material corresponding to the pipe or to the matrix as the welding or soldering material.

The task of the invention is also accomplished by an axial-piston engine with at least one compressor cylinder, with at least one working cylinder and with at least one pressure line through which compressed combustion agent is conducted from the compressor cylinder to the working cylinder, which is characterized by a combustion agent reservoir in which compressed medium can be stored temporarily.

Increased power can be called for, particularly briefly, through such a combustion agent reservoir, without a correspondingly increased quantity of combustion agent first having to be provided by means of the compressors. This is of particular advantage if the compressor pistons of the compressor are directly connected to working pistons, since an increase in combustion agent, which can otherwise ultimately be achieved only by an increase in fuel, can then be supplied merely by increased work output. In this respect, fuel can already be saved thereby.

The combustion agent stored in the combustion agent reservoir can also be used for example for starting procedures of the axial-piston engine.

Preferably, the combustion agent reservoir is provided between the compressor cylinder and a heat exchanger, so that the combustion agent, in particular air provided for the combustion, is temporarily stored in the combustion agent reservoir still cold, or without yet having extracted energy from the heat exchanger. This has a positive effect on the energy balance of the axial-piston engine, as can be seen directly.

It is advantageous, in particular for longer service life, if a valve is situated between the compressor cylinder and the combustion agent reservoir, and/or between the combustion agent reservoir and the working cylinder. In this way, the danger of leakage can be minimized. It is of particular advantage if the combustion agent reservoir can be separated via a valve from the pressure line, or from the assemblies that carry combustion agent during normal operation, by means of a valve. In this way, the combustion agent can be stored in the combustion agent reservoir free of influence from the other operating states of the axial-piston engine.

Furthermore, it is also advantageous, independent of the other features of the present invention, if the pressure line between the compressor cylinder and the working cylinder has a valve, so that the supplying of combustion agent from the combustion agent reservoir can be stopped operationally reliably, in particular in situations in which no combustion agent is needed, as is the case for example when stopped at a traffic light or during braking procedures, even if compressed combustion agent is still being made available by the compressor because of a motion of the axial-piston engine. In particular, a corresponding interruption can then be carried out and the combustion agent made available by the compressor can immediately go directly into the combustion agent reservoir, in order to then be available immediately and without delay for example for driving off and acceleration processes.

It is understood in this connection that—depending on the Concrete embodiment of the axial-piston engine—a plurality of pressure lines can also be provided, which can be appropriately blocked or connected to a combustion agent reservoir, individually or together.

A very advantageous alternative embodiment provides at least two such combustion fuel reservoirs, whereby differing operating states of the axial-piston engine can be regulated with even greater differentiation.

If the at least two combustion agent reservoirs are charged with different pressures, operating states within the combustion chamber can be influenced especially quickly, without needing for example to allow for delays due to an inherent response behavior of regulating valves. In particular, it is possible that the charging times for the reservoirs can be minimized, and in particular that combustion agent can be stored already even at low pressures, while at the same time another reservoir is present that contains combustion agent under high pressure.

Especially varied and intertwined regulation options can accordingly be achieved, if there is a pressure regulating system that defines a first lower pressure limit and a first upper pressure limit for the first combustion agent reservoir, and a second lower pressure limit and a second upper pressure limit for the second combustion agent reservoir, within which a combustion agent reservoir is pressurized, wherein the first upper pressure limit is preferably lower than the second upper pressure limit and the first lower pressure limit is preferably lower than the second lower pressure limit. In particular, the combustion agent reservoirs used can be operated at differing pressure intervals, whereby the energy provided in the form of combustion agent pressure by the axial-piston engine can be used even more effectively.

In order to be able to realize for example an especially rapid response behavior in the axial-piston engine, in particular with regard to a very broad spectrum of work, it is advantageous if the first upper pressure limit is lower than or equal to the second lower pressure limit. By means of pressure intervals chosen in this way, an especially broad pressure range can be made available advantageously.

As explained already in detail above, water can be applied to the axial-piston engine. However, this involves the risk that corrosive processes will be promoted—in particular in areas in which combustion products are already present. In order to prevent the latter, independently of the other features of the present invention an axial-piston engine with at least one compressor cylinder, with at least one working cylinder and with at least one pressure line through which compressed combustion agent is conducted from the compressor cylinder to the working cylinder is proposed, wherein water is applied at some location to the axial-piston engine as combustion agent, i.e., as a material running through the combustion chamber, and which is characterized in that the application of water is stopped before the end of operation of the axial-piston engine and the axial-piston engine is operated for a defined period of time without application of water.

It is understood that the time period is chosen as short as possible, since a user would not wish to wait unnecessarily until the engine stops running, and since the engine is actually no longer needed during this time. On the other hand, the time period is chosen long enough so that the water can be adequately removed, in particular from the areas that are hot or in contact with combustion products. During this time period, combustion agent reservoirs can be charged for example. Also during this time, other shut-down processes can be performed on a motor vehicle, such as for example operationally reliable closing of all windows, wherein the energy supplied by the engine can still be used to this end, which in the final analysis relieves a battery.

In this case, the application of water can be made on the one hand directly into the combustion chamber. On the other hand, the water can be mixed beforehand with combustion agent, which can occur for example during or prior to the compression. A mixing with combustion air or with combustible substance or other combustion agents can also take place at a different location.

Additional advantages, objectives and properties of the present invention will be explained on the basis of the following description of the accompanying drawing, in which various assemblies of axial-piston engines are depicted as examples.

Figure 2:
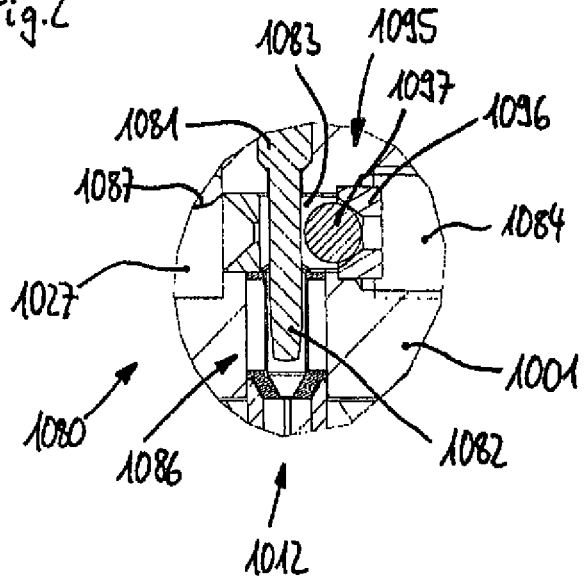
Figure 3:
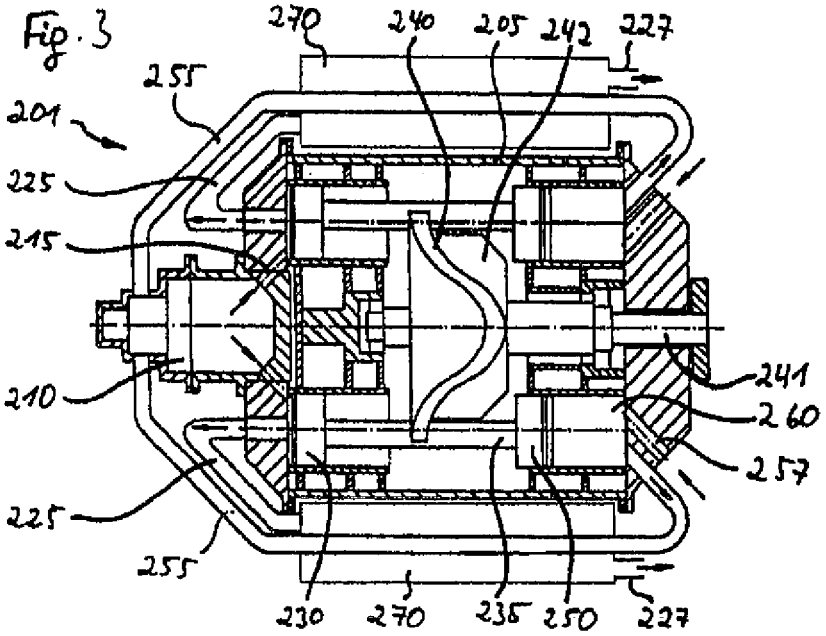
Figure 4:
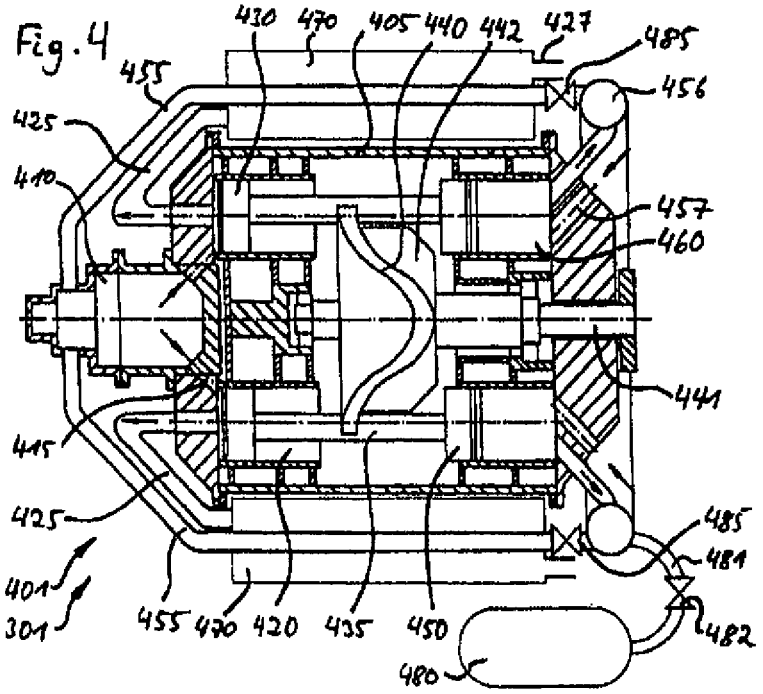
Figure 5:
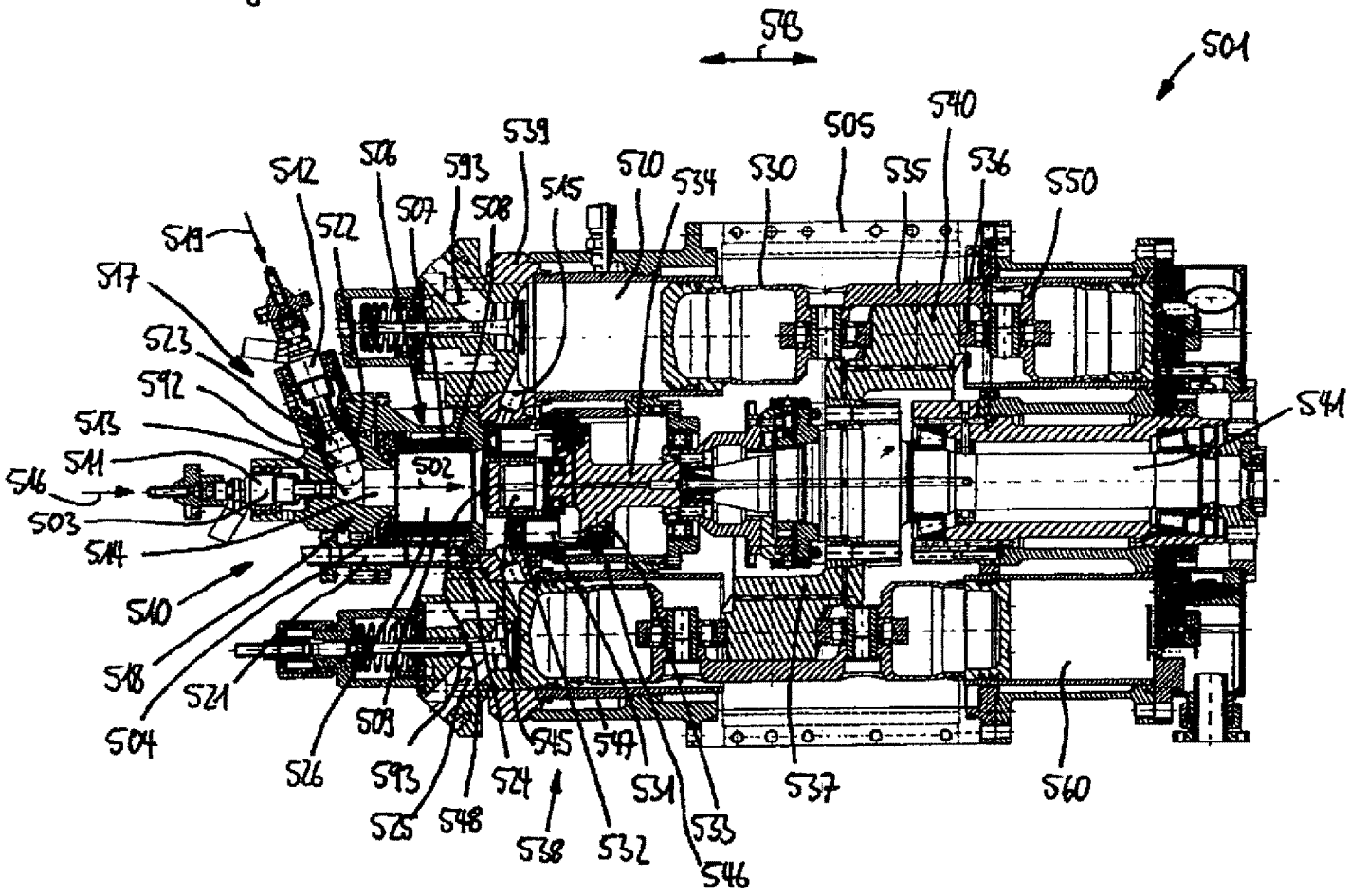
Figure 6:
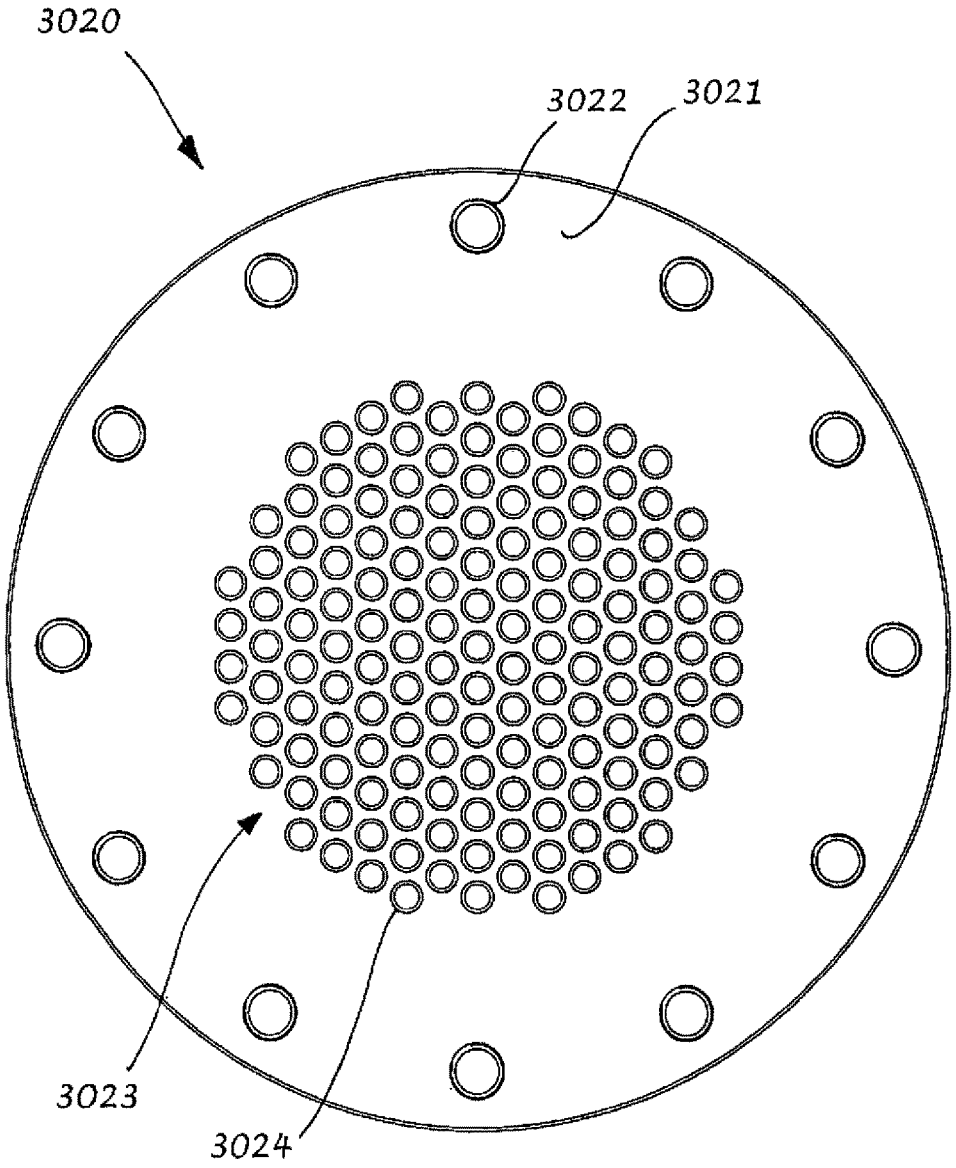

The figures show the following:

FIG. 1 a schematic sectional view of a fuel heating system of an axial-piston engine for its preburner;

FIG. 2 a schematic sectional view of a check valve ahead of a precombustion chamber of an axial-piston engine;

FIG. 3 a schematic sectional view of an axial-piston engine with two heat exchangers, on which the assemblies from FIGS. 1 and 2 can be used advantageously;

FIG. 4 a schematic sectional view of an axial-piston engine with two heat exchangers and with a combustion agent reservoir, on which the assemblies from FIGS. 1 and 2 can be used advantageously;

FIG. 5 a schematic sectional view of another axial-piston engine, on which the assemblies from FIGS. 1 and 2 can likewise be used advantageously; and FIG. 6 a schematic depiction of a flange for a heat exchanger, with a matrix situated in it to receive pipes of a heat exchanger.

The fuel processing system 980 shown in FIG. 1 is placed ahead of a precombustion chamber 927 of an axial-piston engine 901, and includes a fuel heater 981 in the form of a glow plug 982. The glow plug 982 corresponds in this case to a mixing pipe 983 for mixing of fuel 928 and combustion air 929. The combustion air 929 is fed to the mixing pipe 983 by means of a combustion air supply 984 that is axially flush therewith. To supply the fuel 928, the fuel processing system 980 includes a fuel injection system 985 with a processing nozzle 912, which is placed radially to the mixing pipe 983. Arranged in this way, the processing nozzle 912 can apply the fuel 928 to a vaporizer 986, whereby the fuel 928 can be vaporized especially effectively by means of the glow plug 982 before it is fed to the mixing pipe 983.

Combustion agents mixed in this manner—fuel 928 and combustion air 929—can then be applied to the precombustion chamber 927, to burn there completely for example by self-ignition. In particular in a starting phase of the axial-piston engine 901, specifically when the axial-piston engine 901 is still cold and far from its operating temperature, the ignition of the combustion agent can be made easier by having a spark plug 987 ignite the combustion agent. To this end, the spark plug 987 projects into the precombustion chamber 927 on the input side. Alternatively, such a spark plug 987 can also be assigned to a mixing pipe 983 and project into the mixing pipe 983 accordingly.

In the area of the fuel injection system 985 a cooling system 988 is also provided, by means of which overheating of the fuel injection system 985 can be prevented effectively.

According to the schematic sectional view of FIG. 2, in the second exemplary embodiment a check valve 1095 is provided ahead of a precombustion chamber 1027 of an axial-piston engine 1001, whereby the check valve 1095 comprises in a known manner a valve seat 1096 and a corresponding ceramic valve ball 1097. Otherwise the fuel processing system 1080 corresponds to the fuel processing system 980.

In this exemplary embodiment the check valve 1095 is situated between a mixing pipe 1083 of a fuel processing system 1080 and a combustion air supply system 1084 axially flush therewith.

The fuel processing system 1080 includes a fuel heater 1081 in the form of a glow plug 1082 and a processing nozzle 1012 with a vaporizer 1086. By means of the glow plug 1082, a fuel injected by the processing nozzle 1012 can be vaporized in the vaporizer 1086 before it is fed to the mixing pipe 1083 in gaseous form.

In particular during starting processes of the axial-piston engine 1001, the check valve 1095 can contribute to making combustion of combustion agents within the precombustion chamber 1027 uniform, wherein ignition of the combustion agents applied to the precombustion chamber 1027 can be further improved or supported by means of an additional spark plug 1087.

Both the fuel processing system 980 described in FIG. 1 as an example and the check valve 1095 described in FIG. 2 as an example can be used advantageously on axial-piston engines of almost any configuration with at least one working cylinder, that is fed from one continuously working combustion chamber and is equipped with a precombustion chamber and a main combustion chamber, in order to improve the respective efficiency of such an axial-piston engine. Only three axial-piston engines 201, 401 and 501 will now be explained by way of example, in which the fuel processing system 980 and the check valve 1085 can be used advantageously.

In this case in particular the mixing pipes 983, 1083 can also discharge eccentrically into the precombustion chambers 927, 1027. The spark plugs 987, 1087 can likewise be provided in the mixing pipes 983, 1083 or at some other suitable location.

The axial-piston engine 201 depicted as an example in FIG. 3 has a continuously working combustion chamber 210, from which working medium is fed successively via shot channels 215 (numbered as an example) to working cylinders 220 (numbered as an example). Situated in each of the working cylinders 220 are respective working pistons 230 (numbered as an example), which are connected on the one hand by way of a straight connecting rod 235 to an output, which is realized in this exemplary embodiment as a spacer 242 carrying a curved track 240, situated on an output shaft 241, and are connected on the other hand to a compressor piston 250, each of which runs in the compressor cylinder 260 in a manner explained in greater detail below.

After the working medium has performed its work in working cylinder 220 and has placed a load on working piston 230 accordingly, the working medium is expelled from the working cylinder 220 through exhaust gas channels 225. Provided on the exhaust gas channels 225 are temperature sensors, not shown, which measure the temperature of the exhaust gas.

The exhaust gas channels 225 discharge in each instance into heat exchangers 270, and subsequently leave the axial-piston engine 201 at appropriate outlets 227 in a known manner. The outlets 227 for their part can be connected again in particular to an ring channel, not shown, so that in the end the exhaust gas leaves the engine 201 at only one or two places. Depending on the concrete configuration in particular of the heat exchanger 270, a sound damper can possibly also be dispensed with, since the heat exchangers 270 themselves already have a sound-damping effect.

The heat exchangers 270 serve to preheat combustion agent which is compressed in the compressor cylinders 260 by the compressor pistons 250 and conducted through a pressure line 255 to the combustion chamber 210. The compression takes place in this case in a known manner, by the fact that supply air is drawn in through supply lines 257 (numbered as an example) by the compressor pistons 250 and compressed in the compressor cylinders 260. Known and readily appropriately utilizable valve systems are used to this end.

The axial-piston engine 201 has two heat exchangers 270, which in each instance are situated axially in reference to the axial-piston engine 201. Through this arrangement, the paths which the exhaust gas must traverse through the exhaust gas channels 225 to the heat exchangers 270 can be reduced significantly, compared to state-of-the-art axial-piston engines. The result of this is that in the end the exhaust gas reaches the respective heat exchanger 270 at a significantly higher temperature, so that in the end the combustion agent can also be preheated to correspondingly higher temperatures. In practice, it has been found that at least 20% of fuel can be saved through such a configuration. It is assumed in this connection that even savings of up to 30% or more are possible by means of an optimized design.

In this connection it is understood that the efficiency of the axial-piston engine 201 can be increased through additional measures. For example, the combustion agent can be used in a known manner for cooling or thermally insulating the combustion chamber 210, whereby its temperature can be increased still further before it enters the combustion chamber 210. Let it be emphasized here that the corresponding tempering can be limited on the one hand only to components of the combustion agent, as is the case in the present exemplary embodiment in reference to combustion air. It is also conceivable to apply water to the combustion air already before or during the compression; this is also readily possible afterwards, however, for example in the pressure line 255.

Especially preferably, the application of water to the compressor cylinder 260 takes place during an intake stroke of the corresponding compressor piston 250, which results in isothermal compression, or compression as close as possible to isothermal compression. As is directly apparent, each working cycle of the compressor piston 250 comprises an intake stroke and a compression stroke, wherein during the intake stroke combustion agent enters the compressor cylinder 260, which is then compressed, i.e., compressed, during the compression stroke, and conveyed into the pressure line 255. By application of water during the intake stroke, a uniform distribution of the water can be ensured in an operationally simple manner.

Preferably, the fuel is processed as described above. This can be dispensed with, however, depending on the concrete exemplary embodiment.

The application of water in this configuration can also take place in the pressure line 255, wherein the water mixes uniformly with the combustion agent within the heat exchanger due to appropriate deflection of the flow. The exhaust gas channel 225 can also be chosen for the application of water or of another fluid, such as fuel or means for exhaust gas aftertreatment, in order to ensure a homogeneous mixing within the heat exchanger 270. The configuration of the depicted heat exchanger 270 also allows aftertreatment of the exhaust gas in the heat exchanger itself, wherein heat released by the aftertreatment is supplied directly to the combustion agent present in the pressure line 255. Situated in the outlet 227 is a water trap, not shown, which returns the condensed water present in the exhaust gas to the axial-piston engine 201 for renewed application. The water trap can of course be realized in combination with a condenser. Furthermore, use with similarly designed axial-piston engines is of course possible, wherein the other advantageous features of the axial-piston engine 201 or of similar axial-piston engines are advantageous even without use of a water trap in the outlet 227.

The axial-piston engine 401 shown only as an example in FIG. 4 also corresponds essentially to the axial-piston engine 201 according to FIG. 3. Accordingly, identically or similarly working assemblies are labeled similarly, and differ only in the first digit. Accordingly, in other respects a detailed explanation of the mode of operation will also be dispensed with for this exemplary embodiment, since that was already done in reference to the axial-piston engine 201 according to FIG. 3.

The axial-piston engine 401 also includes a housing body 405, on which a continuously working combustion chamber 410, six working cylinders 420 and six compressor cylinders 460 are provided. In this case the combustion chamber 410 is connected via shot channels 415 to the working cylinders 420, in each instance, so that working medium can be fed to the working cylinders 420 corresponding to the timing rate of the axial-piston engine 401.

After its work is done, the working medium leaves the working cylinders 420 in each instance through exhaust gas channels 425, which lead to heat exchangers 470, wherein these heat exchangers 470 are arranged identically to the heat exchangers 270 of the axial-piston engine 201 according to FIG. 3. The working medium leaves the heat exchangers 470 through outlets 427 (numbered as an example).

Situated in the working cylinders 420 and the compressor cylinders 460 are working pistons 430 and compressor pistons 450, respectively, which are connected with one another by means of a rigid connecting rod 435. The connecting rod 435 includes in a known manner a curved track 440, which is provided on a spacer 424, which ultimately drives an output shaft 441.

In this exemplary embodiment also, combustion air is drawn in through supply lines 457 and compressed in the compressor cylinders 460, in order to be applied via pressure lines 455 to the combustion chamber 410, wherein the measures named in the case of the aforementioned exemplary embodiment can likewise be provided, depending on the concrete implementation.

In addition, in the case of the axial-piston engine 401 the pressure lines 455 are connected with one another via an ring channel 456, whereby a uniform pressure in all pressure lines 455 can be guaranteed in a known manner. Between the ring channel 456 and each of the pressure lines 455 valves 485 are provided in each instance, wherein the supply of combustion agent can be regulated or set by the pressure lines 455. Furthermore, a combustion agent reservoir 480 is connected to the ring channel 456 via a reservoir line 481, in which a valve 482 is likewise situated.

The valves 482 and 485 can be opened or closed, depending on the operating state of the axial-piston engine 401. Thus it is conceivable, for example, to close one of the valves 485 when the axial-piston engine 401 needs less combustion agent. It is also conceivable to partially close all valves 485 in such operating situations, and to let them operate as throttles. The surplus of combustion agent can then be fed to the combustion agent reservoir 480 when valve 482 is open. The latter is also possible in particular when the axial-piston engine 401 is running under deceleration, i.e., when no combustion agent at all is needed, but rather it is being driven via the output shaft 441. The surplus of combustion agent caused by the movement of the compressor pistons 450 that occurs in such an operating situation can likewise readily be stored in the combustion agent reservoir 480.

The combustion agent stored in this way can be fed supplementally to the axial-piston engine 401 as needed, i.e., in particular in driving off or acceleration situations, as well as for starting, so that a surplus of combustion agent is provided without additional or more rapid movements of the compressor pistons 450.

The valves 482 and 485 can also be dispensed with, if appropriate, to guarantee the latter. Foregoing such valves for prolonged storage of compressed combustion agent seems little suited, due to unavoidable leakage.

In an alternative embodiment to the axial-piston engine 401, the ring channel 456 can be dispensed with, whereby the outlets of the compressor cylinders 460 are then combined corresponding to the number of pressure lines 455—possibly by means of a section of ring channel. With a configuration of this sort it may possibly make sense to connect only one of the pressure lines 455, or not all of the pressure lines 455, to the combustion agent reservoir, or to provide them as connectible. Such a configuration means, however, that not all compressor pistons 450 can fill the combustion agent reservoir 480 during deceleration. On the other hand, sufficient combustion agent is then available to the combustion chamber 410 so that combustion can be maintained without additional regulating or control measures. Simultaneously with this, the combustion agent reservoir 480 is filled by means of the other compressor pistons 450, so that combustion agent is stockpiled accordingly and is available immediately, in particular for starting, driving off or acceleration phases.

It is understood that the axial-piston engine 401, in a different alternative embodiment not shown explicitly here, can be equipped with two combustion agent reservoirs 480, wherein the two combustion agent reservoirs 480 can then also be charged with different pressures, so that it is always possible with the two combustion agent reservoirs 480 to work with different pressure intervals in real time. Preferably a pressure regulating system is provided in this case, which sets a first lower pressure limit and a first upper pressure limit for the first combustion agent reservoir 480, and a second lower pressure limit and a second upper pressure limit for the second combustion agent reservoir (not shown here), within which a combustion agent reservoir 480 is charged with pressures, wherein the first upper pressure limit is below the second upper pressure limit and the first lower pressure limit is below the second lower pressure limit. Specifically, the first upper pressure limit can be set lower than or equal to the second lower pressure limit.

Not shown explicitly in FIGS. 3 and 4 are temperature sensors for measuring the temperature of the exhaust gas or in the combustion chamber. For such temperature sensors, all temperature sensors can be considered which can operationally reliably measure temperatures between 800° C. and 1,100° C. In particular, if the combustion chamber comprises a precombustion chamber and a main combustion changer, the temperature of the precombustion chamber can be measured by means of such temperature sensors. In this respect, the axial-piston engines 201 and 401 described above can each be regulated by means of the temperature sensors in such a way that the exhaust gas temperature when leaving the working cylinders 220 and 420 is approximately 900° C., and the temperature in the precombustion chamber—if present—is approximately 1,000° C.

In the case of the other axial-piston engine 501 shown as an example according to the depiction in FIG. 5, such temperature sensors are present in the form of a prechamber temperature sensor 592 and two exhaust gas temperature sensors 593, and are depicted schematically accordingly. In particular by means of the prechamber temperature sensor 592—which in this exemplary embodiment can also be referred to as preburner temperature sensor 592, due to its proximity to a preburner 517 of the other axial-piston engine 501—a meaningful value concerning the quality of combustion or with regard to the running stability of the other axial-piston engine 501 is ascertained. For example, a flame temperature can be measured in the preburner 517, in order to be able to regulate different operating states in the other axial-piston engine 501 by means of a combustion chamber regulating system. By means of the exhaust gas temperature sensors 593, which are positioned at outlets or exhaust gas channels 525 of the respective working cylinder 520, specifically the operating state of the combustion chamber 510 can be checked cumulatively and regulated if necessary, so that optimal combustion of the combustion agents is always ensured.

Otherwise, the construction and operating principle of the other axial-piston engine 501 correspond to those of the previously described axial-piston engines. In this respect, the other axial-piston engine 501 has a housing body 505, on which a continuously working combustion chamber 510, six working cylinders 520 and six compressor cylinders 560 are provided.

Inside the combustion chamber 510, combustion agents can be both ignited and burned, wherein the combustion chamber 510 can be charged with combustion agents in the manner described above. Advantageously, the other axial-piston engine 501 works with a two-stage combustion system, to which end the combustion chamber 510 has the previously already mentioned preburner 517 and a main burner 518. Combustion agents can be injected into the preburner 517 and into the main burner 518, wherein a proportion of combustion air of the axial-piston engine 501, which specifically in this exemplary embodiment can be smaller than 15% of the total combustion air, can also be introduced in particular into the preburner 517. Preferably, the pressure at which the combustion air is applied to the preburner 517 is higher than the pressure at which combustion air is applied to the main burner 518. This can be achieved especially easily by using line systems with appropriately differing flow resistances for the corresponding supply lines. In particular, a shorter heat exchanger or even none at all can be used for example for the combustion air applied to the preburner 517, while the combustion air applied to the main burner 518 is conducted through the heat exchanger depicted in the drawing.

The preburner 517 has a smaller diameter than the main burner 518, wherein the combustion chamber 510 has a transition area that comprises a conical chamber 513 and a cylindrical chamber 514.

To supply combustion agents and combustion air, on the one hand a main nozzle 511 and on the other hand a processing nozzle 512 discharge into the combustion chamber 510, in particular into the associated conical chamber 513. By means of the main nozzle 511 and the processing nozzle 512, combustion agents or combustible substance can be injected into the combustion chambers 510, wherein in this exemplary embodiment the combustion agents injected by means of the processing nozzle 512 are mixed with combustion air via a perforated ring 523.

The main nozzle 511 is aligned essentially parallel to a main combustion direction 502 of the combustion chamber 510. Furthermore, the main nozzle 511 is aligned coaxially to an axis of symmetry 503 of the combustion chamber 510, wherein the axis of symmetry 503 lies parallel to the main combustion direction 502.

Furthermore, the processing nozzle 512 is situated at an angle (not sketched in explicitly here for the sake of clarity) with respect to the main nozzle 511, so that a jet direction 516 of the main nozzle 511 and a jet direction 519 of the processing nozzle 512 intersect at a mutual point of intersection within the conical chamber 513. In this way, the fuel can be processed from the main nozzle 511 through the preburner 517, and in particular is thermally decomposed before it arrives in the combustion space 526.

Combustible substance or fuel is injected from the main nozzle 511 into the main burner 518 in this exemplary embodiment without further air supply, and is thermally decomposed by the preburner 517, as already explained earlier. To this end, the volume of combustion air corresponding to the quantity of combustible substance flowing through the main nozzle 511 is introduced into a combustion space 526 behind the preburner 517 or the main burner 518, to which end a separate combustion air supply system 504 is provided, which discharges into the combustion space 526.

To this end, the separate combustion air supply system 504 is connected to a process air supply 521, which is carried to the heat exchanger, not shown here, wherein another combustion air supply 522 can be supplied with combustion air directly from the compressor or compressor piston 550, which in this case supply a perforated ring 523 with combustion air. The perforated ring 523 is assigned in this case to the processing nozzle 512. In this respect, the combustible substance injected with the processing nozzle 512, mixed additionally with process air, can be injected into the preburner 517 or into the conical chamber 513 of the main burner 518.

In addition, the combustion chamber 510, in particular the combustion space 526, includes a ceramic assembly 506, which is advantageously air-cooled. The ceramic assembly 506 includes in this case a ceramic combustion chamber wall 507, which in turn is surrounded by a profiled pipe 508. Around this profiled pipe 508 extends a cooling air chamber 509, which is connected to the process air supply system 521 by means of a cooling air chamber supply system 524.

The known working cylinders 520 carry corresponding working pistons 530, which are mechanically connected in each case with compressor pistons by means of connecting rods 535.

In this exemplary embodiment the connecting rods 535 include connecting rod running wheels 536, which run along a curved track 540, while the working pistons 530 or the compressor pistons 550 are moved. An output shaft 541 is thereby set in rotation, which is connected to the curved track 540 by means of a driving curved track carrier 537. Power produced by the axial-piston engine 501 can be delivered via the output shaft 541.

In a known way, by means of the compressor pistons 550 compression of the process air occurs, also including injected water if appropriate, which can be used if necessary for additional cooling. If the application of water or of water vapor occurs during an intake stroke of the corresponding compressor piston 550, isothermal compression of the combustion agent can specifically be promoted. An application of water that accompanies the intake stroke can ensure an especially uniform distribution of the water within the combustion agent, in an operationally simple manner.

Exhaust gases can be cooled significantly more deeply thereby, if necessary, in one or more heat exchangers not depicted here (but see FIG. 4), if the process air is to be prewarmed by means of one or more such heat exchangers and carried to the combustion chamber 510 as combustion agent, as already described in detail for example in the exemplary embodiment explained above for FIG. 4. The exhaust gases can be fed to the heat exchanger or heat exchangers via the exhaust gas channels 525 named above, wherein the heat exchangers are arranged axially in reference to the other axial-piston engine 501.

In addition, the process air can be further prewarmed or heated through a contact with additional assemblies of the axial-piston engine 501 that must be cooled, as has also already been explained. The process air compressed and heated in this way is then applied to the combustion chamber 510 in a manner that has already been explained, whereby the efficiency of the other axial-piston engine 501 can be further increased.

Each of the working cylinders 520 of the axial-piston engine 501 is connected via a shot channel 515 to the combustion chamber 510, so that an ignited fuel-air mixture can pass out of the combustion chamber 510 via the shot channels 515 into the respective working cylinder 520 and can perform work on the working pistons 530 as a working medium.

In this respect, the working medium flowing from the combustion chamber 510 can be fed via at least one shot channel 515 successively to at least two working cylinders 520, wherein for each working cylinder 520 one shot channel 515 is provided, which is closed and opened by means of a control piston 531. Thus the number of control pistons 531 of the other axial-piston engine 501 is predetermined by the number of working cylinders 520. Closing the shot channel 515 is done in this case by means of the control piston 531, including its control piston cover 532. The control piston 531 is driven by means of a control piston curved track 533, wherein a spacer 534 for the control piston curved track 533 to the output shaft 541 is provided, which also serves in particular for thermal decoupling. In the present exemplary embodiment of the other axial-piston engine 501, the control piston 531 can perform an essentially axially directed stroke motion 543. To this end, each of the control pistons 531 is guided by means of sliders, not further labeled, which are supported in the control piston curved track 533, wherein the sliders each have a safety cam that runs back and forth in a guideway, not further labeled, and prevents turning of the control piston 531.

Since the control piston 531 comes into contact in the area of the shot channel 515 with the hot working medium from the combustion chamber 510, it is advantageous if the control piston 531 is water-cooled. To this end, the other axial-piston engine 501 has a water cooling system 538, in particular in the area of the control piston 531, wherein the water cooling system 538 includes inner cooling channels 545, middle cooling channels 546 and outer cooling channels 547. Well cooled in this way, the control piston 531 can be moved operationally reliably in a corresponding control piston cylinder.

Furthermore, the surfaces of the control piston 531 that are in contact with combustion agent are reflective, or are provided with a reflective coating, so that a heat input into the control pistons 531 that occurs by way of heat radiation is minimized. The other surfaces of the shot channels 515 and of the combustion chamber 510 that are in contact with combustion agents in this exemplary embodiment (likewise not shown) are also provided with a coating with elevated spectral reflectivity. This applies in particular to the combustion chamber floor (not labeled explicitly), but also to the ceramic combustion chamber wall 507. It is understood that this configuration of the surfaces that are in contact with combustion agent can also be present in an axial-piston engine, independently of the other configuration features. It is understood that in modified embodiments additional assemblies can also be reflective, or else that the aforenamed reflectivenesses can be at least partially dispensed with.

The shot channels 515 and the control pistons 531 can be provided using especially simple configuration, if the other axial piston engine 501 has a shot channel ring 539. In this case the shot channel ring 539 has a middle axis, around which in particular the parts of the working cylinders 520 and of the control piston cylinders are arranged concentrically. Between each working cylinder 520 and control piston cylinder a shot channel 515 is provided, wherein every shot channel 515 is spatially connected to a cutout (not labeled here) of a combustion chamber floor 548 of the combustion chamber 510. In this respect, the working medium can pass from the combustion chamber 510 via the shot channels 515 into the working cylinders 520 and there perform work, by means of which the compressor pistons 550 can also be moved. It is understood that coatings and inserts can also be provided, depending on the concrete configuration, in order to protect in particular the shot channel ring 539 or its material from direct contact with corrosive combustion products or with excessively high temperatures. The combustion chamber floor 548 in turn can be characterized by another ceramic or metallic coating, in particular reflectiveness, on its surface, which on the one hand reduces the heat radiation occurring from the combustion chamber 510 by increasing the reflectivity, and on the other hand reduces the heat conduction by lowering the thermal conductivity.

It is understood that the other axial-piston engine 501 for example can likewise be equipped with at least one combustion fuel reservoir and corresponding valves, although this is not shown explicitly in the concrete exemplary embodiment according to FIG. 6. In addition, in the case of the other axial-piston engine the combustion agent reservoir can be provided in a double version, in order to be able to store compressed combustion agents at different pressures. The two existing combustion agent reservoirs can be connected in this case to corresponding pressure lines of the combustion chamber 510, wherein the combustion agent reservoirs are fluid-connectible with or separable from the pressure lines by means of valves. Stop valves or throttle valves, or regulating or control valves, can be provided in particular between the working cylinders 520 or compressor cylinders 560 and the combustion agent reservoir. For example, the aforementioned valves can be opened or closed appropriately during driving-off or acceleration situations, as well as for starting, whereby a surplus of combustion agent can be made available to the combustion chamber 510, at least for a limited period of time. The combustion agent reservoirs are interconnected fluidically preferably between one of the compressor cylinders and one of the heat exchangers. The two combustion agent reservoirs are ideally operated at different pressures, in order thereby to be able to make very good use of the energy provided by the other axial-piston engine 501 in the form of pressure. To this end, the provided upper pressure limit and lower pressure limit at the first combustion agent reservoir can be set by means of an appropriate pressure regulating system below the upper pressure limits and lower pressure limits of the second combustion agent reservoir. It is understood that in this case work can be done on the combustion agent reservoirs with different pressure intervals.

Not shown in the drawing is a thermal insulation of the heat exchangers 270, 470, or of the heat exchangers, not shown, of the axial-piston engine 501. To this end, an asbestos substitute is placed in an appropriate manner around the respective heat exchangers, which is subsequently secured by a housing. This ensures that with these exemplary embodiments the external temperature of the axial-piston engine does not exceed 450° C. in the vicinity of the heat exchangers under nearly all operating conditions. The only exceptions are overload situations, which occur only briefly anyway. In this case, the thermal insulation is designed to ensure a temperature gradient of 350° C. at the hottest place on the heat exchanger.

FIG. 6 shows a heat exchanger head plate 3020 which is suitable for use for a heat exchanger for an axial-piston engine. For the purpose of mounting on and connection to an output manifold of an axial-piston engine, the heat exchanger head plate 3020 includes a flange 3021 with corresponding bore holes 3022 arranged in a circle of holes in the radially outer area of the heat exchanger head plate 3020. In the radially inner area of the flange 3021 is the matrix 3023, which has numerous bore holes designed as pipe seats 3024 for accommodation of pipes.

The entire heat exchanger head plate 3020 is preferably made from the same material from which the pipes are also made, in order to ensure that the thermal expansion coefficient is as homogeneous as possible in the entire heat exchanger and that thermal stresses in the heat exchanger are thereby minimized. Cumulatively to this, the jacket housing of the heat exchanger can likewise be produced from a material that corresponds to the heat exchanger head plate 3020 or to the pipes. The pipe seats 3024 can be designed for example with a fit such that the pipes mounted in these pipe seats 3024 are inserted by means of a press fit.

Alternatively to this, the pipe seats 3024 can also be designed so that a clearance fit or a transition fit is realized. In this way, installation of the pipes in the pipe seats 3024 can be carried out by means of a materially bonded connection rather than a frictional connection. The material connection is preferably effected in this case by welding or soldering, wherein a material corresponding to the heat exchanger head plate 3020 or to the pipes is used as the soldering or welding material. This also has the advantage that thermal stresses in the pipe seats 3024 can be minimized by homogeneous thermal expansion coefficients.

It is also possible in the case of this solution to install pipes in the pipe seats 3024 by force fit, and in addition to this to solder or weld them. Through this type of installation, seal tightness of the heat exchanger can also be ensured, if different materials are used for the pipes and the heat exchanger head plate 3020, since the possibility exists that due to the very high occurring temperatures of over 1,000° C. use of only a press fit can possibly fail under certain circumstances because of different thermal expansion coefficients.

| Reference labels: | |
|---|---|
| 201 | axial-piston engine |
| 205 | housing body |
| 210 | combustion chamber |
| 215 | shot channel |
| 220 | working cylinder |
| 225 | exhaust gas channel |
| 227 | outlet |
| 230 | working piston |
| 235 | connecting rod |
| 240 | curved track |
| 241 | output shaft |
| 242 | spacer |
| 250 | compressor piston |
| 255 | pressure line |
| 257 | supply line |
| 260 | compressor cylinder |
| 270 | heat exchanger |
| 401 | axial-piston engine |
| 405 | housing body |
| 410 | combustion chamber |
| 415 | shot channel |
| 420 | working cylinder |
| 425 | exhaust gas channel |
| 427 | outlet |
| 430 | working piston |
| 435 | connecting rod |
| 440 | curved track |
| 441 | output shaft |
| 442 | spacer |
| 450 | compressor piston |
| 455 | pressure line |
| 456 | ring channel |
| 457 | supply line |
| 460 | compressor cylinder |
| 470 | heat exchanger |
| 480 | combustion agent reservoir |
| 481 | reservoir line |
| 485 | valve |
| 501 | axial-piston engine |
| 502 | main combustion direction |
| 503 | axis of symmetry |
| 504 | combustion air supply system |
| 505 | housing body |
| 506 | ceramic assembly |
| 507 | ceramic combustion chamber wall |
| 508 | profiled pipe |
| 509 | cooling air chamber |
| 510 | combustion chamber |
| 511 | main nozzle |
| 512 | processing nozzle |
| 513 | conical chamber |
| 514 | cylindrical chamber |
| 515 | shot channel |
| 516 | first jet direction |
| 517 | preburner |
| 518 | main burner |
| 519 | other jet direction |
| 520 | working cylinder |
| 521 | process air supply |
| 522 | other combustion air supply |
| 523 | perforated ring |
| 524 | cooling air chamber supply |
| 525 | exhaust gas channel |
| 526 | combustion space |
| 530 | working piston |
| 531 | control piston |
| 532 | control piston cover |
| 533 | control piston curved track |
| 534 | spacer |
| 535 | connecting rod |
| 536 | connecting rod running wheels |
| 537 | driving curved track carrier |
| 538 | water cooling system |

-continued

| Reference labels: | |
|---|---|
| 539 | shot channel ring |
| 540 | curved track |
| 541 | output shaft |
| 543 | stroke motion |
| 545 | inner cooling channels |
| 546 | middle cooling channels |
| 547 | outer cooling channels |
| 548 | combustion chamber floor |
| 550 | compressor piston |
| 560 | compressor cylinder |
| 592 | prechamber temperature sensor |
| 593 | exhaust gas temperature sensor |
| 901 | axial-piston engine |
| 912 | processing nozzle |
| 927 | precombustion chamber |
| 928 | fuel |
| 929 | combustion air |
| 980 | fuel processing system |
| 981 | fuel heater |
| 982 | glow plug |
| 983 | mixing pipe |
| 984 | flush combustion air supply |
| 985 | fuel injection system |
| 986 | vaporizer |
| 987 | spark plug |
| 988 | cooling system |
| 1001 | axial-piston engine |
| 1012 | processing nozzle |
| 1027 | precombustion chamber |
| 1080 | fuel processing system |
| 1081 | fuel heater |
| 1082 | glow plugs |
| 1083 | mixing pipe |
| 1084 | flush combustion air supply |
| 1086 | vaporizer |
| 1087 | spark plug |
| 1095 | check valve |
| 1096 | valve seat |
| 1097 | ceramic valve ball |
| 3020 | heat exchanger head plate |
| 3021 | flange |
| 3022 | mounting hole |
| 3023 | matrix |
| 3024 | pipe seat |

The invention claimed is:

1. An axial-piston engine with at least one compressor cylinder, with at least one working cylinder, and with at least one pressure line, through which compressed combustion agent is conducted from the compressor cylinder to the working cylinder, the axial-piston engine comprising a combustion agent reservoir in which compressed medium can be stored temporarily, the axial-piston engine further comprising a first heat exchanger, a second heat exchanger, a first valve for the first heat exchanger, and a second valve for the second heat exchanger, wherein exhaust channels lead from the working cylinders to said first and second heat exchanger, and wherein the combustion agent reservoir is provided between the compressor cylinder and the first heat exchanger and is provided between the compressor cylinder and the second heat exchanger; and wherein the first heat exchanger or the second heat exchanger is in the pressure line for heating up compressed gas; and wherein the first valve is situated a) between the combustion agent reservoir and the compressor cylinder and also situated between the combustion agent reservoir and a combustion chamber and b) wherein the second valve is situated between the combustion agent reservoir and the compressor cylinder.

2. The axial-piston engine according to claim 1, wherein said at least one working cylinder, is fed from a continuously working combustion chamber that includes a precombustion chamber and a main combustion chamber into which fuel being thermally decomposed by a flame in said precombustion chamber is injected, wherein the precombustion chamber includes a mixing pipe for mixing fuel and combustion air and a fuel processing system which is situated ahead of said mixing pipe, and wherein the fuel processing system vaporizes fuel inserted into the precombustion chamber before entry into the precombustion chamber when said fuel has not already come into contact with combustion air.

3. The axial-piston engine according to claim 2, wherein the fuel processing system is situated ahead of a mixing pipe for mixing fuel and other combustible substances.

4. The axial-piston engine according to claim 2, wherein the combustion air fed to the precombustion chamber is tempered by a combustion agent processing system.

5. The axial-piston engine according to claim 4, wherein the combustion agent processing system includes a combustion agent heater, for example a glow plug, a glow coil, an induction heater or a laser heater.

6. The axial-piston engine according to claim 2, wherein the precombustion chamber has an eccentric combustion agent input.

7. The axial-piston engine according to claim 2, wherein the precombustion chamber has two combustion air inputs.

8. The axial-piston engine according to claim 7, wherein the two combustion-air inputs are designed for differently tempered combustion air.

9. The axial-piston engine according to claim 1, further comprising a third valve, the third valve being situated between the compressor cylinder and the combustion agent reservoir.

10. The axial-piston engine according to claim 1, comprising at least two combustion agent reservoirs.

11. The axial-piston engine according to claim 10, wherein the at least two combustion agent reservoirs are charged with different pressures.

12. The axial-piston engine according to claim 11, comprising a pressure regulating system that defines a first lower pressure limit and a first upper pressure limit for the first combustion agent reservoir, and a second lower pressure limit and a second upper pressure limit for the second combustion agent reservoir, within which the first combustion agent reservoir and the second combustion agent reservoir are pressurized, wherein the first upper pressure limit is lower than the second upper pressure limit and the first lower pressure limit is preferably lower than the second lower pressure limit.

13. The axial-piston engine according to claim 12, wherein the first upper pressure limit is lower than or equal to the second lower pressure limit.

14. The axial-piston engine according to claim 1, wherein the first heat exchanger and the second heat exchanger are in the pressure line for heating up compressed gas.

* * * * *